US006226465B1

(12) United States Patent
Funatani

(10) Patent No.: US 6,226,465 B1
(45) Date of Patent: May 1, 2001

(54) IMAGE FORMING APPARATUS WITH RELATIVE SPEED DIFFERENTIAL BETWEEN INTERMEDIATE TRANSFER MEMBER AND IMAGE BEARING MEMBER

(75) Inventor: Kazuhiro Funatani, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/401,370

(22) Filed: Sep. 22, 1999

(30) Foreign Application Priority Data

Sep. 25, 1998 (JP) ..... 10-288889
Sep. 2, 1999 (JP) ..... 11-248648

(51) Int. Cl.[7] ..... G03G 15/16

(52) U.S. Cl. ..... 399/44; 399/66; 399/302

(58) Field of Search ..... 399/44, 66, 302, 399/308

(56) References Cited

U.S. PATENT DOCUMENTS 5,508,789 * 4/1996 Castelli et al. ..... 399/8
5,778,291 * 7/1998 Okubo et al. ..... 399/302
6,026,269 * 2/2000 Setoriyama ..... 399/302

* cited by examiner

*Primary Examiner*—Joan Pendegrass
(74) *Attorney, Agent, or Firm*—Fitzpatrick, Cella, Harper & Scinto

(57) ABSTRACT

An image forming apparatus having a movable image bearing member bearing a toner image thereon, and a movable intermediate transfer member to which the toner image on the image bearing member is transferred at a transfer position, the toner image on the intermediate transfer member being transferred to a transfer material, wherein the ratio of the moving speed of the intermediate transfer member at the transfer position to the moving speed of the image bearing member at the transfer position is 1.002 to 1.020, and the linear load between the image bearing member and the intermediate transfer member at the transfer position is 10 to 70 g/cm.

20 Claims, 5 Drawing Sheets

IMAGE FORMING APPARATUS WITH RELATIVE SPEED DIFFERENTIAL BETWEEN INTERMEDIATE TRANSFER MEMBER AND IMAGE BEARING MEMBER

BACKGROUND OF THE INVENTION

1. Field of the Invention

This invention relates to an image forming apparatus using the electrophotographic method such as a copying apparatus, a printer or a facsimile apparatus.

2. Related Background Art

Image forming apparatuses according to the earlier technology use various methods such as the electrophotographic method, the thermal transfer method and the ink jet method. Among these, the electrophotographic method is excellent as compared with the other methods in terms of high speed, high quality of image and quietude, and has widely spread in recent years.

A color image forming apparatus using this electrophotographic method is grouped into various methods such as the multi-development method in which color images are superposed on the surface of a photosensitive member, whereafter they are collectively transferred to thereby effect image formation, the multi-transfer method in which the cycle of development-transfer is repetitively effected, and the intermediate transfer method in which developed images of respective colors are once sequentially transferred onto an intermediate transfer member, and thereafter are collectively transferred to a transfer material, among these, particularly the intermediate transfer method is an excellent method for the reasons that there is no possibility of colors being mixed with one another and that application to various media is possible.

FIG. 5 of the accompanying drawings shows an example of the construction of the intermediate transfer belt method which is an intermediate transfer method. In FIG. 5, a photosensitive drum 101 is rotated in the direction indicated by the arrow, and around the peripheral surface thereof, there are disposed a plurality of developing devices, i.e., a black developing device 105, a magenta developing device 106, a cyan developing device 107 and a yellow developing device 108, which are designed to be brought into contact with the photosensitive drum 101 by means, not shown, as required.

The photosensitive drum 101 is uniformly charged by a charger 102, and a latent image is formed thereon by a laser beam 104 with the aid of a laser exposure optical system 103 or the like. Next, this latent image is developed by one of the aforementioned developing devices 105 to 108, and is sequentially primary-transferred onto an intermediate transfer belt 109 rotated in the direction indicated by the arrow in a primary transfer portion (transfer position). The above-described steps are also successively effected with respect to the other developing devices, and color images of four colors superposed on top of one another are formed on the intermediate transfer belt 109, whereupon a secondary transfer roller 111 is brought into contact with the intermediate transfer belt with a transfer material 118 interposed therebetween, and the color images are collectively secondary-transferred onto the transfer material 118.

At the above-described primary transfer step, if the photosensitive drum 101 is, for example, an OPC (organic photoconductor) photosensitive member of the negative polarity, toners of the negative polarity are used when the exposed portion exposed by the laser beam 104 is developed by the developing devices 105 to 108, and accordingly, a transfer bias of the positive polarity is applied from a bias voltage source 120 to the primary transfer roller 110, and transfer is effected.

However, when in the primary transfer portion of the above-described image forming apparatus, the peripheral speeds of the photosensitive drum 101 and the intermediate transfer belt 109 are equal to each other, there has been the problem that sufficient transfer efficiency is not obtained and a so-called hollow image (edge effect) is created.

SUMMARY OF THE INVENTION

It is an object of the present invention to provide an image forming apparatus which can prevent hollow characters from being created in a toner image transferred from an image bearing member to an intermediate transfer member and also which can stably keep a pressure force with which transfer means presses the intermediate transfer member against the image bearing member to prevent toner from fusing and bonding to the image bearing member or the intermediate transfer member.

In accordance with these objects there is provided an image forming apparatus having a movable image bearing member for bearing a toner image thereon, a movable intermediate transfer member, and transfer means for pressing the intermediate transfer member against the image bearing member at a transfer position at which the image bearing member is in con tact with the intermediate transfer member so that the transfer means transfers the toner image on the image bearing member to the intermediate transfer member, wherein the toner image transferred onto the intermediate transfer member by the transfer means is transferred to a transfer material, wherein a ratio of a moving speed of the intermediate transfer member at the transfer position to a moving speed of the image bearing member at the transfer position is 1.002 to 1.020, and a pressure force with which the transfer means presses the intermediate transfer member against the image bearing member is 10 to 70 g/cm.

In accordance with yet another aspect of the invention, there is provided an image forming apparatus having a movable image bearing member bearing a toner image thereon, a movable intermediate transfer member to which the toner image on the image bearing member is transferred at a transfer position, the toner image on the intermediate transfer member being transferred to a transfer material, detecting means for detecting temperature and humidity in a main body of the apparatus, and control means for controlling a ratio of a moving speed of the intermediate transfer member at the transfer position to a moving speed of the image bearing member at the transfer position based on a result of detection by the detecting means.

The above and other objects, features an advantages of the present invention will become more apparent upon consideration of the following description of the preferred embodiments of the present invention taken in conjunction with the accompanying drawings.

DESCRIPTION OF THE PREFERRED EMBODIMENTS

The image forming apparatus according to the present invention will hereinafter be described in greater detail with reference to the drawings.

Embodiment 1

A first embodiment of the present invention will hereinafter be described with reference to FIGS. 1 and 2.

Figure 1:
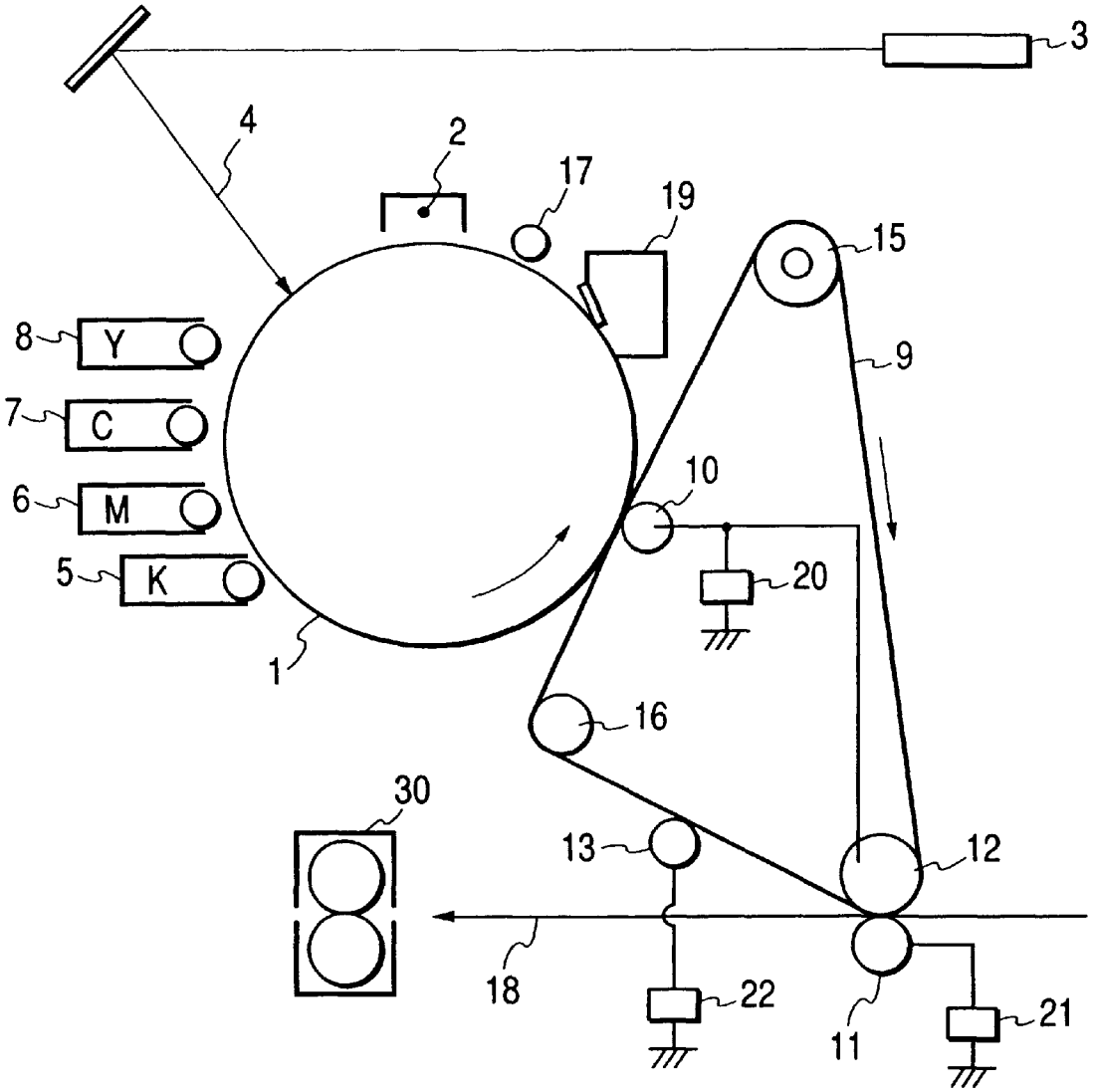
FIG. 1 shows a construction of a first embodiment of an image forming apparatus according to the present invention.

FIG. 1 shows a color image forming apparatus of the intermediate transfer belt type according to the present embodiment. In FIG. 1, a photosensitive drum 1 which is an image bearing member is rotated in a direction indicated by the arrow, and around the peripheral surface thereof, there are disposed a plurality of developing devices, i.e., a black developing device 5, a magenta developing device 6, a cyan developing device 7 and a yellow developing device 8, which are designed to be brought into contact with the photosensitive drum 1 by means, not shown, as required.

The photosensitive drum 1 is uniformly charged by a charger 2, and a latent image is formed by a laser beam 4 with the aid of a laser exposure optical system 3 or the like. Next, this latent image is developed by one of the aforementioned developing devices 5 to 8, and is sequentially primary-transferred onto an intermediate transfer belt 9 which is an intermediate transfer member rotated in a direction indicated by the arrow at a transfer position. The above-described steps are sequentially effected with respect also to the other developing devices, and color images of four colors superposed on top of one another are formed on the intermediate transfer belt 9. A secondary transfer roller 11 is then brought into contact with a transfer material 18 so that the transfer material 18 may contact with the intermediate transfer belt 9, and the color images are collectively secondary-transferred onto the transfer material 18. The toner image is fixed on the transfer material 18 onto which the secondary transfer has been completed, by a fixing device 30, and the transfer material 18 is discharged out of the apparatus.

These primary and secondary transfer steps will now be described in greater detail.

First, at the primary transfer step, if the photosensitive drum 1 is, for example, an OPC photosensitive member of the negative polarity, toners of the negative polarity are used when an exposed portion exposed by the laser beam 4 is developed by the developing devices 5 to 8 and accordingly, a transfer bias of the positive polarity is applied from a bias voltage source 20 to a primary transfer roller 10.

The intermediate transfer belt 9 is passed over a drive roller 15, a tension roller 16 and an opposed roller 12, and as this intermediate transfer belt 9, use can be made of one comprising a resin layer of good mold releasing ability provided on resin film such as PVdF, polyamide, polyimide, PET or polycarbonate usually having a thickness of 100 $\mu$m to 200 $\mu$m and electric resistivity of $10^{11}\Omega$.cm to $10^{16}\Omega$.cm or a base layer of rubber having a thickness of the order of 0.5 to 2 mm, and as the primary transfer roller 10, it is preferable to use a low-resistance roller of $10^{5}\Omega$.cm or less.

The transfer nip width in the primary transfer portion may preferably be 0.2 to 5 mm in order to prevent the problems that a linear load (contact pressure) is not stable in the thrust direction and that a toner image transferred to the intermediate transfer belt is counter-transferred to the photosensitive drum 1. In the present embodiment, it is about 1.5 mm.

Next, at the secondary transfer step, the opposed roller 12 having its back grounded or having a suitable bias applied thereto is used as an opposed electrode, and a bias of the positive polarity is applied from a bias voltage source 21 to the secondary transfer roller 11 brought into contact with the back of the transfer material 18.

Any residual toner remaining on the intermediate transfer belt 9 after secondary transfer has imparted thereto charges of the opposite polarity and is electrostatically counter-transferred onto the photosensitive drum 1 and removed by a bias comprising an AC component superposed on a DC component being applied from a bias voltage source 22 to a retractable contact type roller charger (hereinafter referred to as the "cleaning roller") 13 which is an intermediate transfer belt cleaning device.

Any residual toner remaining on the photosensitive drum 1 after the termination of primary transfer is collected by a cleaner 19, and the surface of the photosensitive drum 1 is initialized by a residual charge eliminating exposure device 17 and is used for the next image forming cycle.

In the present embodiment, as the intermediate transfer belt 9, use is made of one comprising a surface layer consisting of fluoroplastic such as PTFE dispersed in urethane rubber and provided on a base layer of EPDM rubber having a peripheral length of 400 mm and a thickness of 1 mm. Also, as the primary transfer roller 10, use is made of a sponge roller having Asker C hardness of 30 to 60 degrees.

Figure 2:
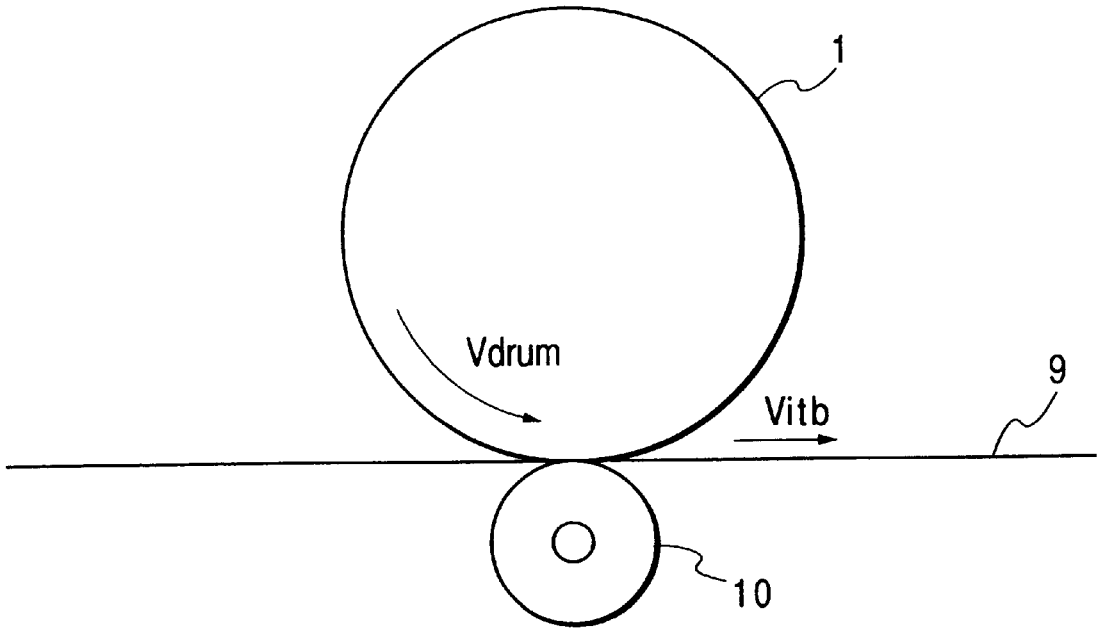
FIG. 2 is an illustration showing a primary transfer portion (transfer position) of the image forming apparatus of FIG. 1.

The primary transfer roller 10, as shown in FIG. 2, is brought into contact with the photosensitive drum 1 with the intermediate transfer belt 9 interposed therebetween, and from the opposite ends thereof, pressure (linear load) of 115 g/cm is imparted thereto by a spring (not shown).

According to the inventor's experiment, when as described above, the peripheral speed (Vdrum) of the photosensitive drum 1 in the primary transfer portion (transfer position) and the peripheral speed (Vitb) of the intermediate transfer belt 9 in the primary transfer portion (transfer position) were made equal to each other, sufficient transfer efficiency was not obtained and an edge effect (hollow characters) occurred.

So, it is conceivable to set Vdrum so as to differ from Vitb in order to prevent the edge effect (hollow characters), but if Vdrum is made higher than Vitb, the toner image transferred from the photosensitive drum 1 to the intermediate transfer belt 9 will shrink in the direction of rotation of the intermediate transfer belt 9, as compared with the original image. By this shrinkage, the layer thickness of the toner image on the intermediate transfer belt 9 becomes great as compared with the case where Vdrum and Vitb are equal to each other, and due to a centrifugal force or the like, the toner sometimes scattered from the intermediate transfer belt 9, particularly in the bent portions of the intermediate transfer belt 9. Consequently, in the present embodiment, Vitb is set so as to be higher than Vdrum.

Description will now be made of a method of measuring the peripheral speed ratio Vitb/Vdrum between Vdrum and Vitb.

(1) Two line toner images extending in the main scanning direction at an interval of 1 cm in the sub-scanning direction are formed on the photosensitive drum 1. In the present embodiment, the width of one line in the sub-scanning direction was set to a width corresponding to 4 dots.

(2) The interval between the two line toner images formed on the photosensitive drum 1 is measured, and this is defined as A.

(3) The line toner images are successively formed at an interval of 1 cm on the photosensitive drum 1, and these images are successively transferred to the intermediate transfer belt 9.

(4) When 31 line toner images are transferred onto the intermediate transfer belt 9, the rotation of the intermediate transfer belt 9 is stopped.

(5) The 31 line toner images transferred onto the intermediate transfer belt 9 are made to adhere to a tape difficult to elongate such as a Mylar tape, and the tape is stuck on suitable paper, and the distances between adjacent line toner images are measured and the sum thereof is formed. This sum is defined as B.

(6) The elongation rate C of the toner images is found from the following expression:

$$C = \frac{B}{30 \times A}$$

The elongation rate C obtained by way of the above-described steps (1) to (6) corresponds to the peripheral speed ratio Vitb/Vdrum and therefore, the peripheral speed ratio can be found from the elongation rate C.

When the influence of the eccentricity or the like of the photosensitive drum 1 cannot be neglected, the steps (1) and (2) may be repeated and the average value of data obtained thereby may be used as A.

It has been found that when the peripheral speed of the intermediate transfer belt 9 was gradually increased, hollow images came not to be created when the peripheral speed ratio (Vitb/Vdrum) between the photosensitive drum 1 and the intermediate transfer belt 9 was Vitb/Vdrum ≧1.020. Now, it is the same thing as grazing the photosensitive drum 1 by the intermediate transfer belt 9 to provide a difference between the peripheral speeds of the photosensitive drum 1 and the intermediate transfer belt 9, and when as the result, Vitb/Vdrum ≧1.015, it has been found that the toner fusion-bonds to the photosensitive drum 1 and the intermediate transfer belt 9, and the prevention of hollow images and the prevention of the fusion bond of the toner could not be made compatible. The above result is summed up in Table 1 below. In Table 1, the mark 0 shows a good state and the mark x shows a bad state.

TABLE 1

| Vitb/Vdrum | 1.000 | 1.002 | 1.005 | 1.010 | 1.015 | 1.020 | 1.025 | 1.030 | 1.035 |
|---|---|---|---|---|---|---|---|---|---|
| hollow characters | x | x | x | x | x | ○ | ○ | ○ | ○ |
| toner fusion bond | ○ | ○ | ○ | ○ | x | x | x | x | x |

So, the inventor optimized the difference between the peripheral speeds of the photosensitive drum 1 and the intermediate transfer belt 9 and the pressure in the primary transfer portion to thereby carry out experiments regarding the compatibility of the prevention of hollow characters and the prevention of toner fusion bond. Particularly, under an environment of 20° C. and 60% RH, the experiments were carried out with the pressure force (linear load) of the intermediate transfer belt 9 against the photosensitive drum 1 by the primary transfer roller 10 changed to 2 g/cm, 4.5 g/cm, 10 g/cm, 23 g/cm, 45 g/cm, 70 g/cm, 90 g/cm, 115 g/cm and 136 g/cm. In the respective experiments, the primary transfer bias was of the same value. The results are shown in Tables 2 to 10 below.

TABLE 2 pressure = 2 g/cm

| Vitb/Vdrum | 1.000 | 1.002 | 1.005 | 1.010 | 1.015 | 1.020 | 1.025 | 1.030 | 1.035 |
|---|---|---|---|---|---|---|---|---|---|
| hollow characters | ○ | ○ | ○ | ○ | ○ | ○ | ○ | ○ | ○ |
| toner fusion bond | ○ | ○ | ○ | ○ | ○ | ○ | ○ | ○ | ○ |
| transfer failure | x | x | x | x | x | x | x | x | x |

TABLE 3 pressure = 4.5 g/cm

| Vitb/Vdrum | 1.000 | 1.002 | 1.005 | 1.010 | 1.015 | 1.020 | 1.025 | 1.030 | 1.035 |
|---|---|---|---|---|---|---|---|---|---|
| hollow characters | ○ | ○ | ○ | ○ | ○ | ○ | ○ | ○ | ○ |
| toner fusion bond | ○ | ○ | ○ | ○ | ○ | ○ | ○ | ○ | ○ |
| transfer failure | x | x | x | x | x | x | x | x | x |

TABLE 4 pressure = 10 g/cm

| Vitb/Vdrum | 1.000 | 1.002 | 1.005 | 1.010 | 1.015 | 1.020 | 1.025 | 1.030 | 1.035 |
|---|---|---|---|---|---|---|---|---|---|
| hollow characters | x | ○ | ○ | ○ | ○ | ○ | ○ | ○ | ○ |
| toner fusion bond | ○ | ○ | ○ | ○ | ○ | ○ | ○ | ○ | x |
| transfer failure | ○ | ○ | ○ | ○ | ○ | ○ | ○ | ○ | ○ |

TABLE 5 pressure = 23 g/cm

| Vitb/Vdrum | 1.000 | 1.002 | 1.005 | 1.010 | 1.015 | 1.020 | 1.025 | 1.030 | 1.035 |
|---|---|---|---|---|---|---|---|---|---|
| hollow characters | x | ○ | ○ | ○ | ○ | ○ | ○ | ○ | ○ |
| toner fusion bond | ○ | ○ | ○ | ○ | ○ | ○ | ○ | x | x |
| transfer failure | ○ | ○ | ○ | ○ | ○ | ○ | ○ | ○ | ○ |

TABLE 6 pressure = 45 g/cm

| Vitb/Vdrum | 1.000 | 1.002 | 1.005 | 1.010 | 1.015 | 1.020 | 1.025 | 1.030 | 1.035 |
|---|---|---|---|---|---|---|---|---|---|
| hollow characters | x | ○ | ○ | ○ | ○ | ○ | ○ | ○ | ○ |

TABLE 6-continued

| pressure = 45 g/cm | | | | | | | | | |
|---|---|---|---|---|---|---|---|---|---|
| Vitb/ Vdrum | 1.000 | 1.002 | 1.005 | 1.010 | 1.015 | 1.020 | 1.025 | 1.030 | 1.035 |
| toner fusion bond | ○ | ○ | ○ | ○ | ○ | ○ | ○ | x | x |
| transfer failure | ○ | ○ | ○ | ○ | ○ | ○ | ○ | ○ | ○ |

TABLE 7

| pressure = 70 g/cm | | | | | | | | | |
|---|---|---|---|---|---|---|---|---|---|
| Vitb/ Vdrum | 1.000 | 1.002 | 1.005 | 1.010 | 1.015 | 1.020 | 1.025 | 1.030 | 1.035 |
| hollow characters | x | ○ | ○ | ○ | ○ | ○ | ○ | ○ | ○ |
| toner fusion bond | ○ | ○ | ○ | ○ | ○ | ○ | x | x | x |
| transfer failure | ○ | ○ | ○ | ○ | ○ | ○ | ○ | ○ | ○ |

TABLE 8

| pressure = 90 g/cm | | | | | | | | | |
|---|---|---|---|---|---|---|---|---|---|
| Vitb/ Vdrum | 1.000 | 1.002 | 1.005 | 1.010 | 1.015 | 1.020 | 1.025 | 1.030 | 1.035 |
| hollow characters | x | x | ○ | ○ | ○ | ○ | ○ | ○ | ○ |
| toner fusion bond | ○ | ○ | ○ | ○ | ○ | x | x | x | x |
| transfer failure | ○ | ○ | ○ | ○ | ○ | ○ | ○ | ○ | ○ |

TABLE 9

| pressure = 115 g/cm | | | | | | | | | |
|---|---|---|---|---|---|---|---|---|---|
| Vitb/ Vdrum | 1.000 | 1.002 | 1.005 | 1.010 | 1.015 | 1.020 | 1.025 | 1.030 | 1.035 |
| hollow characters | x | x | x | x | x | ○ | ○ | ○ | ○ |
| toner fusion bond | ○ | ○ | ○ | ○ | x | x | x | x | x |
| transfer failure | ○ | ○ | ○ | ○ | ○ | ○ | ○ | ○ | ○ |

TABLE 10

| pressure = 136 g/cm | | | | | | | | | |
|---|---|---|---|---|---|---|---|---|---|
| Vitb/ Vdrum | 1.000 | 1.002 | 1.005 | 1.010 | 1.015 | 1.020 | 1.025 | 1.030 | 1.035 |
| hollow characters | x | x | x | x | x | x | x | ○ | ○ |
| toner fusion bond | ○ | ○ | x | x | x | x | x | x | x |

TABLE 10-continued

| pressure = 136 g/cm | | | | | | | | | |
|---|---|---|---|---|---|---|---|---|---|
| Vitb/ Vdrum | 1.000 | 1.002 | 1.005 | 1.010 | 1.015 | 1.020 | 1.025 | 1.030 | 1.035 |
| transfer failure | ○ | ○ | ○ | ○ | ○ | ○ | ○ | ○ | ○ |

Here, description will be made of a method of measuring the pressure force of the intermediate transfer belt 9 against the photosensitive drum 1 by the primary transfer roller 10.

Figure 4:
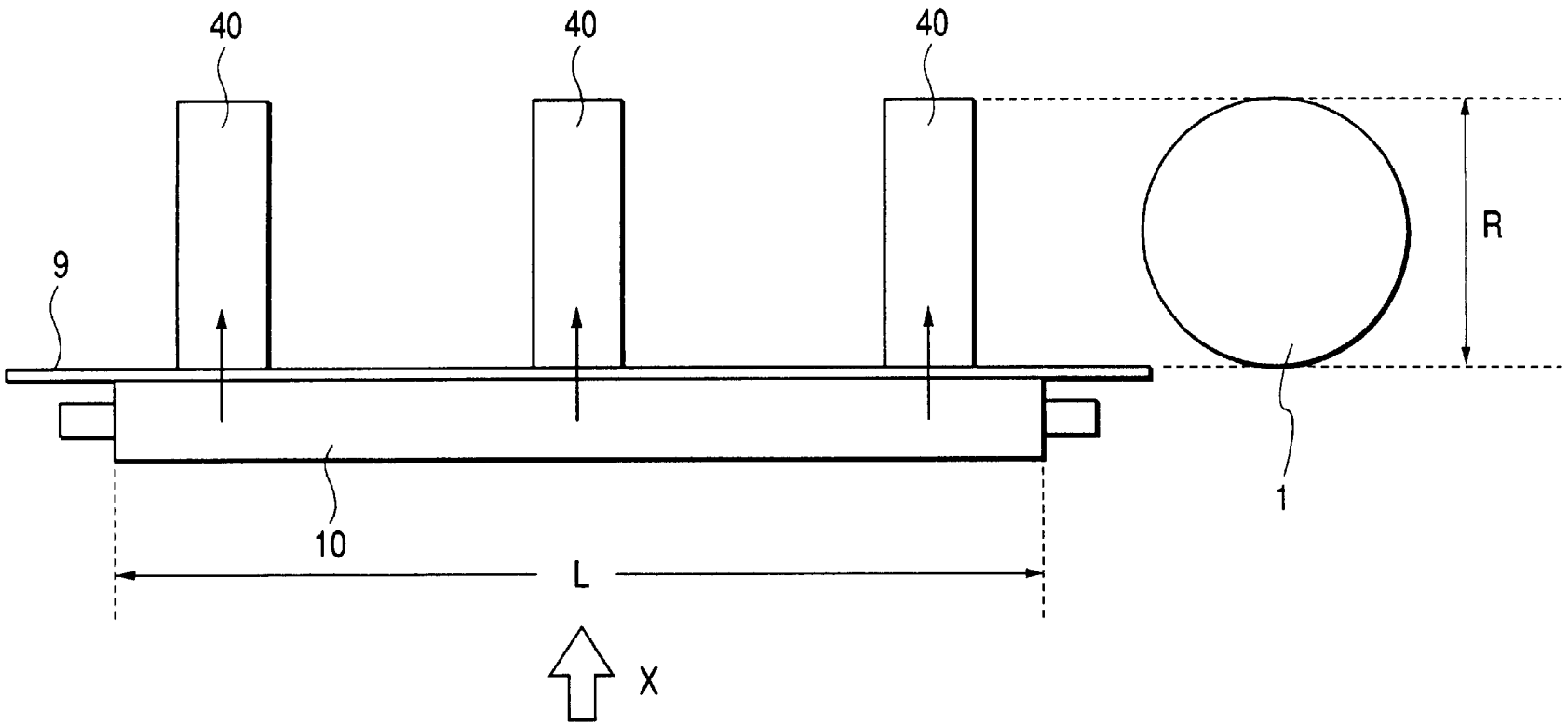
FIG. 4 schematically shows a construction of a system for measuring a linear load at a transfer position.
Figure 5:
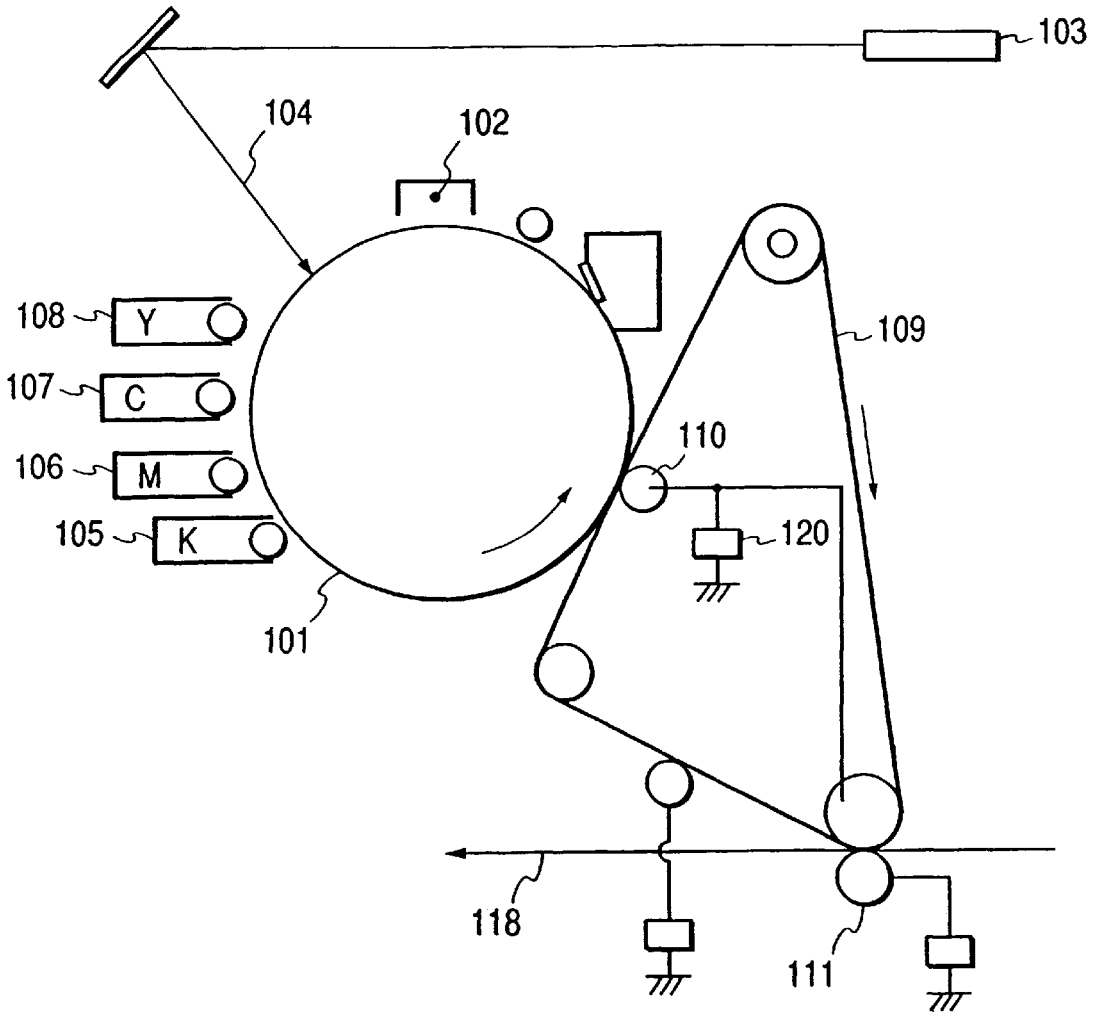
FIG. 5 PRIOR ART
FIG. 5 shows a construction of an example of an image forming apparatus according to the earlier technology.

As shown in FIG. 4, a jig having three rings (rigid members) 40 having the same diameter R as that of the photosensitive drum 1 is inserted into the main body of the apparatus instead of the photosensitive drum 1. In this state, the forces with which the respective rings 40 are pushed by a pressure sensor, and the sum of these measured force is found. By dividing this sum by a length (in the present embodiment, the length of the primary transfer roller 10) L over which the primary transfer roller 10 and the photosensitive drum 1 overlap each other as viewed from the direction indicated by the arrow X in FIG. 4, the "pressure force" can be found.

As can be seen from the results shown above, weaker pressure is more advantageous against toner fusion bond and hollow images. However, if the pressure is 4.5 g/cm or less, the contact is too weak and therefore, transfer failure occurred in the primary transfer portion.

Also, if the pressure became 115 g/cm or greater, hollow characters and toner fusion bond occurred, and even if a difference was provided between the peripheral speeds of the photosensitive drum 1 and the intermediate transfer belt 9, the prevention of hollow characters and the prevention of toner fusion bond could not be made compatible. Further, when the pressure was 90 g/cm, there could be obtained a peripheral speed for which the prevention of hollow characters and the prevention of toner fusion bond could be made compatible, but the range thereof is narrow and this is not realistic when the manufacturing tolerance of the diameter of the drive roller 15 for rotatively driving the intermediate transfer belt 9 which is the main factor for determining the peripheral speed of the intermediate transfer belt 9 is taken into consideration.

Accordingly, by setting the contact pressure in the primary transfer portion to 10 g/cm or greater and 70 g/cm or less and the peripheral speed ratio (Vitb/Vdrum) between the photosensitive drum 1 and the intermediate transfer belt 9 to 1.002 or greater and 1.020 or less, hollow characters and toner fusion bond can be prevented without causing transfer failure.

Embodiment 2

Figure 3:
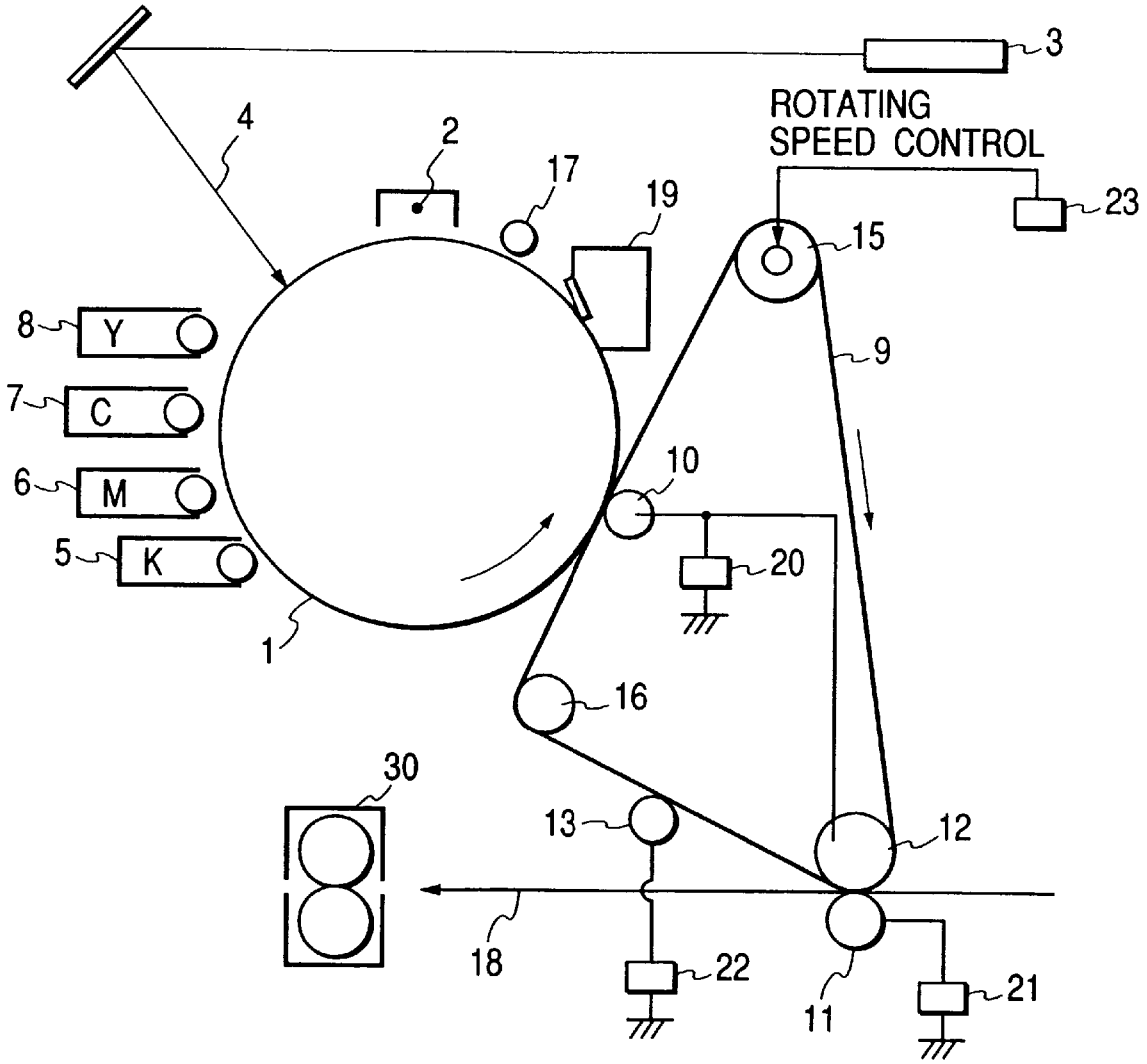
FIG. 3 shows a construction of a second embodiment of the image forming apparatus according to the present invention.

A second embodiment of the present invention will now be described with reference to FIG. 3.

The color image forming apparatus of the present embodiment has a construction and a function substantially similar to those of the first embodiment, and has further added thereto a construction in which the temperature and humidity in the apparatus are detected by an environmental sensor 23 and on the basis of the result of the detection, the peripheral speed of the intermediate transfer belt 9 is changed.

Particularly, the rotating speed of a motor (not shown) for driving the drive roller 15 of the intermediate transfer belt 9 is controlled on the basis of the result of the detection by the environmental sensor 23 to thereby make the peripheral speed of the intermediate transfer belt 9 variable. It is to be understood that at this time, the peripheral speed of the photosensitive drum 1 is constant.

According to the inventor's experiment, under high temperature and high humidity environment, e.g. under 30° C./80% RH environment, the fluidity of the toner is reduced and therefore hollow characters become liable to occur, and to prevent this, it is necessary to make the peripheral speed difference between the photosensitive drum 1 and the intermediate transfer belt 9 greater than under 20° C./60% RH environment.

However, as already described with respect to the first embodiment, if the peripheral speed difference is made too great, tone fusion bond will be aggravated. So, under high temperature and high humidity environment, it is necessary to make the peripheral speed difference great within such a range that toner fusion bond is not aggravated.

The results of experiments carried out under high temperature and high humidity environment by the inventor are summed up in Table 11 and Table 12 below. The contact pressure of the intermediate transfer belt 9 with the photosensitive drum 1 is two kinds, i.e., 10 g/cm and 70 g/cm.

TABLE 11

| | pressure = 10 g/cm | | | | | | | | |
|---|---|---|---|---|---|---|---|---|---|
| Vitb/Vdrum | 1.000 | 1.002 | 1.005 | 1.010 | 1.015 | 1.020 | 1.025 | 1.030 | 1.035 |
| hollow characters | x | x | ○ | ○ | ○ | ○ | ○ | ○ | ○ |
| toner fusion bond | ○ | ○ | ○ | ○ | ○ | ○ | ○ | ○ | x |
| transfer failure | ○ | ○ | ○ | ○ | ○ | ○ | ○ | ○ | ○ |

TABLE 12

| | pressure = 70 g/cm | | | | | | | | |
|---|---|---|---|---|---|---|---|---|---|
| Vitb/Vdrum | 1.000 | 1.002 | 1.005 | 1.010 | 1.015 | 1.020 | 1.025 | 1.030 | 1.035 |
| hollow characters | x | x | x | ○ | ○ | ○ | ○ | ○ | ○ |
| toner fusion bond | ○ | ○ | ○ | ○ | ○ | ○ | x | x | x |
| transfer failure | ○ | ○ | ○ | ○ | ○ | ○ | ○ | ○ | ○ |

As can be seen from the results shown above, even under high temperature and high humidity environment, by setting the peripheral speed ratio between the photosensitive drum 1 and the intermediate transfer belt 9 to $$1.010 \leqq Vitb/Vdrum \leqq 1.020,$$

i.e., a value greater than under 20° C./60% RH environment, the prevention of hollow characters and the prevention of toner fusion bond can be made compatible. Also, the contact pressure at this time is equal to or greater than 10 g/cm and equal to or less than 70 g/cm as in the first embodiment.

The above embodiments have been described with respect to a case where the intermediate transfer member is of a belt shape, but of course, the present invention can be applied to a case where the intermediate transfer member is of a drum shape.

For example, a cylinder of Al (aluminum) or like material having the resin film described in the above embodiments provided thereon can be used as the intermediate transfer drum. In this case, the pressure force (g/cm) between the photosensitive drum and the intermediate transfer drum in the primary transfer portion is adjusted so as to assume a desired value as in the above-described embodiments by a member such as a spring for biasing the rotary shaft of the intermediate transfer drum toward the photosensitive drum side.

The present invention can also be applied to an image forming apparatus which is provided with photosensitive drums for yellow, magenta, cyan and black and in which toner images of respective colors on the respective photosensitive drums are sequentially transferred to an intermediate transfer member, whereafter the color toner images layered on the intermediate transfer member are transferred to a transfer material.

While the invention has been described with respect to the structure disclosed herein, it is not confined to the details set forth and this application is intended to cover such modifications or changes as may come within the purposes of the improvements or the scope of the appended claims.

What is claimed is:

1. An image forming apparatus comprising:

a movable image bearing member for bearing a toner image thereon;

a movable intermediate transfer member; and transfer means for pressing said intermediate transfer member against said image bearing member at a transfer position at which said image bearing member is in contact with said intermediate transfer member so that said transfer means transfers the toner image on said image bearing member to said intermediate transfer member, wherein the toner image transferred onto said intermediate transfer member by said transfer means is transferred to a transfer material, wherein a ratio of a moving speed of said intermediate transfer member at said transfer position to a moving speed of said image bearing member at said transfer position is 1.002 to 1.020, and a pressure force with which said transfer means presses said intermediate transfer member against said image bearing member is 10 to 70 g/cm.

2. An image forming apparatus according to claim 1, wherein said transfer means is provided with a roller.

3. An image forming apparatus according to claim 2, wherein an Asker C hardness of said roller is 10 to 60 degrees.

4. An image forming apparatus according to claim 3, wherein said intermediate transfer member is provided with an elastic layer and a resin layer on said elastic layer.

5. An image forming apparatus according to claim 4, wherein said elastic layer is a rubber layer.

6. An image forming apparatus according to claim 1, wherein said intermediate transfer member is of a belt shape.

7. An image forming apparatus according to claim 6, further comprising a plurality of rollers supporting said intermediate transfer member.

8. An image forming apparatus according to claim 1, further comprising detecting means for detecting the temperature and humidity in said image forming apparatus, and control means for controlling said ratio of the moving speed of said intermediate transfer member to the moving speed of said image bearing member based on a result of detection by said detecting means.

9. An image forming apparatus according to claim 8, wherein said control means controls the moving speed of said intermediate transfer member based on the result of the detection by said detecting means.

10. An image forming apparatus according to any one of claims 1 or 2 to 9, wherein a transfer of the toner image on said image bearing member to said intermediate transfer member is repeated to thereby form toner images of a plurality of colors on said intermediate transfer member, and the toner images of the plurality of colors on said intermediate transfer member are transferred to the transfer material.

11. An image forming apparatus comprising:

a movable image bearing member bearing a toner image thereon;

a movable intermediate transfer member to which the toner image on said image bearing member is transferred at a transfer position, the toner image on said intermediate transfer member being transferred to a transfer material;

detecting means for detecting temperature and humidity in a main body of said apparatus; and control means for controlling a ratio of a moving speed of said intermediate transfer member at said transfer position to a moving speed of said image bearing member at said transfer position based on a result of detection by said detecting means.

12. An image forming apparatus according to claim 11, wherein said control means controls the moving speed of said intermediate transfer member at said transfer position based on the result of the detection by said detecting means.

13. An image forming apparatus according to claim 11, further comprising transfer means for electrostatically transferring the toner image on said image bearing member to said intermediate transfer member at said transfer position.

14. An image forming apparatus according to claim 13, wherein said transfer means is provided with a roller.

15. An image forming apparatus according to claim 14, wherein an Asker C hardness of said roller is 10–60 degrees.

16. An image forming apparatus according to claim 15, wherein said intermediate transfer member is provided with an elastic layer and a resin layer on said elastic layer.

17. An image forming apparatus according to claim 16, wherein said elastic layer is a rubber layer.

18. An image forming apparatus according to claim 11, wherein said intermediate transfer member is of a belt shape.

19. An image forming apparatus according to claim 18, further comprising a plurality of rollers supporting said intermediate transfer member.

20. An image forming apparatus according to any one of claims 11 to 19, wherein a transfer of the toner image on said image bearing member to said intermediate transfer member is repeated to thereby form toner images of a plurality of colors on said intermediate transfer member, and the toner images of the plurality of colors on said intermediate transfer member are transferred to the transfer material.

* * * * *

UNITED STATES PATENT AND TRADEMARK OFFICE

CERTIFICATE OF CORRECTION

PATENT NO. : 6,226,465 B1
DATED : May 1, 2001
INVENTOR(S) : Kazuhiro Funatani

It is certified that error appears in the above-identified patent and that said Letters Patent is hereby corrected as shown below:

Column 2,
Line 27, "con tact" should read -- contact --.

Column 8,
Line 10, "description" should read -- a description --.

Column 10,
Line 38, "material," should read -- material, and --.

Signed and Sealed this

Twenty-second Day of January, 2002

*Attest:*

*Attesting Officer*

JAMES E. ROGAN
*Director of the United States Patent and Trademark Office*